US005984009A

United States Patent [19]

DiFoggio

[11] Patent Number: 5,984,009

[45] Date of Patent: Nov. 16, 1999

[54] LOGGING TOOL RETRIEVAL SYSTEM

[75] Inventor: Rocco DiFoggio, Houston, Tex.

[73] Assignee: Western Atlas International, Inc., Houston, Tex.

[21] Appl. No.: 09/019,663

[22] Filed: Feb. 6, 1998

[51] Int. Cl.[6] ..... E21B 33/00

[52] U.S. Cl. ..... 166/250.13; 166/98; 166/301; 73/152.56

[58] Field of Search ..... 73/152.56, 152.54; 166/254.1, 254.2, 255.1, 250.13, 301, 66, 98

[56] References Cited

U.S. PATENT DOCUMENTS 3,637,038 1/1972 Tanner ..... 166/255.1

5,477,921 12/1995 Tollefsen ..... 166/250.13

5,520,245 5/1996 Estes ..... 166/66

*Primary Examiner*—William Neuder

*Attorney, Agent, or Firm*—Richard A. Fagin

[57] ABSTRACT

An apparatus as method for identifying, locating, and retrieving a downhole tool from a borehole. A controller is lowered into the borehole and is capable of detecting a signal from the tool. The signal can be broadcast from the tool, can be generated in response to a signal from the controller, or can be reflected from a controller signal. The controller processes the signal to identify the location and heading of the controller from the tool, and to guide the controller toward the tool. When the controller is moved proximate to the tool, a catch mechanism can be activated to connect the tool and controller housing. The tool is then dislodged for further operation, or is retrieved to the borehole surface.

20 Claims, 2 Drawing Sheets

LOGGING TOOL RETRIEVAL SYSTEM

BACKGROUND OF THE INVENTION

The present invention relates to the field of well tools located downhole in a borehole. More particularly, the invention relates to an apparatus and method for locating and for retrieving downhole well tools.

Logging tools and other devices are run downhole in boreholes to investigate subterranean structures and to perform different exploratory and production operations. Logging tools are typically lowered into a borehole with a wireline which provides a structural connection to surface equipment and further provides a conductor for transmitting power and electrical signals. Wirelines are subject to failure due to wear and to binding forces exerted by the borehole wall against the tool. When a wireline separates from a logging tool in a vertical or inclined borehole, gravity pulls the tool lower within the borehole. Accordingly, the last known location of the logging tool may not accurately reflect the final resting location of the tool. Such location may be particularly difficult to locate in multilateral wells having multiple borehole branches.

Rig down time caused by a lost logging tool is costly. Wireline failure can strand a logging tool thousands of feet downhole in borehole, and abandonment of a million dollar logging tool is not economic. Loose logging tools impede further rig operations, and drilling rig time on offshore wells can cost over one hundred thousand dollars per day. This cost is increased by the travel time required by well contractors specializing in tool retrieval. When a tool is lost in a well, such well contractors may travel for one or more days to reach the borehole site before the tool retrieval operations can begin. Although certain of these costs can be avoided by effective equipment maintenance, logging tools are also lost due to tool sticking, formation collapse, and other causes unrelated to the wireline.

The process of locating and retrieving a lost tool (known as a "fish") is known as "fishing". Casing collar search tools are sometimes successful in locating lost tools. Alternatively, fishing operations are typically conducted by lowering a drill string into the borehole until the drill string lower end contacts the lost tool. Such contact places weight on the lost tool and reduces the weight on the drill string. If the tool is lodged in the borehole, the drill string weight can further drive the tool into the geologic formations. The reduction in drill string weight is monitored to identify contact with the downhole tool, however the weight reduction is almost imperceptible in deep boreholes requiring a long drill string. Additionally, false weight readings can occur in deviated and horizontal wells as the drill string contacts the borehole wall.

After the lower end of the drill string has located the downhole tool, an "overshot" is attached to the tool for retrieval to the borehole surface. Overshots typically comprise a coiled steel ribbon which is lowered over a tool. The overshot constricts to grip the tool as the drill string and overshot are withdrawn from the borehole. Overshots are effective when the tool is stuck in the borehole and the wireline is still attached to the tool. In such circumstances, the wireline guides the overshot over the tool end so that an effective grip can be achieved. However, overshots are difficult to operate when the tool has parted from the wireline and the tool location is unknown.

Accordingly, a need exists for an improved system for locating and retrieving tools downhole in a borehole. The system should be easy to deploy and to operate, and should be sufficiently flexible to handle different lost tool conditions.

SUMMARY OF THE INVENTION

The present invention provides an apparatus and method for locating a downhole well tool and for retrieving the tool. The apparatus comprises a housing moveable within the borehole, a means for generating a signal indicating the tool location downhole in the borehole, a controller attached to said housing for detecting the signal, and a mechanism for engaging the housing and the tool. In different embodiments of the invention, the controller can initiate a signal to the tool, and the tool can reflect the controller signal or can include a beacon for returning a beacon signal to the controller. The controller can determine the distance between the housing and the tool, and a catch can be attached to the tool for selectively engaging the mechanism.

The method of the invention is practiced by moving the housing within the borehole, by operating the controller to detect a signal emanating from the tool and to identify the distance between the housing and tool, and by operating the mechanism to engage the tool. In different embodiments of the method, the controller can broadcast the signal to the tool, or the tool beacon can broadcast a signal to the controller. The catch can engage the mechanism to permit retrieval of the tool from the borehole.

DESCRIPTION OF THE PREFERRED EMBODIMENTS

Figure 1:
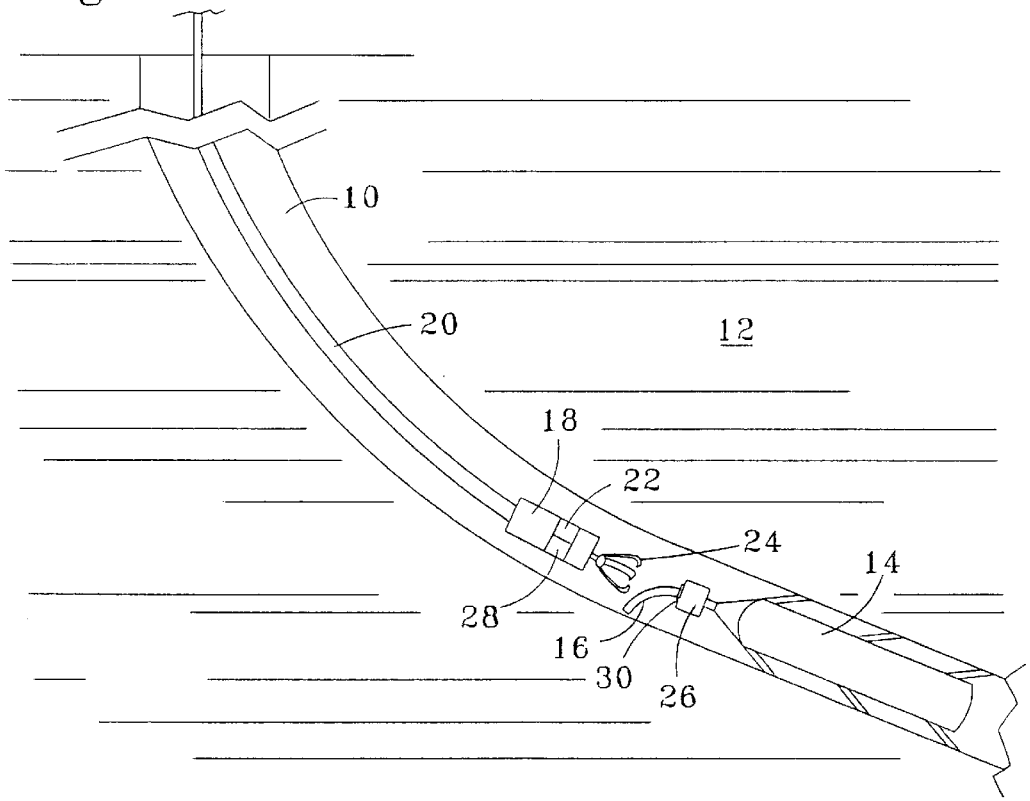
FIG. 1 illustrates a housing lowered into proximity with a logging tool lodged downhole in a borehole.

The present invention provides an apparatus and method for locating a downhole well tool and for retrieving the tool from the borehole. FIG. 1 illustrates borehole 10 within subterranean geologic formations 12. A tool such as logging tool 14 is located within borehole 10 and is attached to severed wireline end 16. The other length of the original tool wireline is removed from borehole 10 and is not illustrated. In this position, tool 14 is "lost" within borehole 10 because surface control of tool 14 has ceased. The location of tool 14 may not be accurately known, thereby hampering efforts to dislodge or to retrieve tool 14.

As shown in FIG. 1, housing 18 is lowered into borehole 10 with another wireline such as cable 20. Although cable 20 is illustrated as a multistrand wireline cable, cable 20 can also comprise a tubular member such as drill pipe, coiled tubing, or other component useful in pushing housing 18 into deviated and horizontal boreholes 10. For all embodiments of the invention, housing 18 can be lowered into an open hole borehole 10 or can be lowered through well tubing or casing (not shown) within borehole 10.

Housing 18 includes controller 22 and grappling attachment 24. Controller 22 can detect a signal emanating from tool 14 and can indicate the location of tool 14 relative to housing 18 to facilitate movement of housing 18 toward tool 14. Controller 22 can perform these functions in different ways. In one embodiment of the invention as shown in FIG. 1, beacon 26 is attached to tool 14 and generates a signal detectable by receiver 28 within controller 22. Such beacon signal can comprise an acoustic rescue signal or other signal suitable for transmission within borehole 10 or through geologic formations 12. Beacon 26 can be enclosed within an interior volume of tool 14, can be enclosed within cable head 30 connecting tool 14 and wireline end 16, or can be attached to the exterior of tool 14. Beacon 26 can be powered through the original tool wireline or with battery or capacitor power if wireline end 16 is damaged or severed as illustrated in FIG. 1.

Beacon 26 can operate continuously or can be activated upon the occurrence of different events. Beacon 26 can emit an acoustic rescue signal or other signal detectable by controller 22. For example, beacon 26 can be selectively activated if wireline 16 is separated from tool 14, or if tool 14 is normally moveable and becomes stationary for a selected time period, or if signal communication between tool 14 and the surface of borehole 10 is lost. In another embodiment of the invention, beacon 26 can be activated by the transmission of a controller signal from controller 22 or another exterior signal generating source.

The acoustic rescue signal generated by beacon 26 can comprise a simple "ping" detectable by controller 22. The ping can be transmitted at regular intervals or in a particular sequence. The sequence can be designed to identify the particular tool in a borehole 10 having multiple tools, can be sequenced to identify the power reserves remaining, or can be sequenced to respond to other signals such as a signal generated from the well surface or from a position downhole in borehole 10.

In one embodiment of the invention, controller 22 can broadcast a signal such as an acoustic signal which is reflected by tool 14 and partially returned to controller 22 for detection. The reflected signal can be processed by controller 22 to identify the location of tool 14 relative to housing 18. In another embodiment of the invention previously discussed, controller 22 can broadcast a controller signal which is received by beacon 26, and which instructs beacon 26 to send a beacon signal in response. The returning beacon signal detected by controller 22 can be processed to determine the elapsed transmission time for the controller signal and the returning beacon signal, and the calculated distance between tool 14 and housing 18. The distance between controller 22 and tool 14 comprises the elapsed time between transmission of the controller signal and the receipt of the beacon signal, minus the response time required by beacon 26 after the controller signal is received. The intensity of the signal can be processed, depending on the transmission media through borehole 10 or through geologic formations 12 for a sidetrack or offset measurement, to determine the distance between tool 14 and housing 18.

As controller 22 is lowered into borehole 10, controller 22 can estimate the remaining distance between controller 22 and tool 14. As controller 22 travels closer to tool 14, the round trip travel time of the controller signal and reflected signal or beacon signal will become shorter. Twice the change in controller 22 depth divided by the change in round trip travel time is equal to the average sound speed in borehole 10. The borehole distance between controller 22 and tool 14 can be approximated by multiplying one-half the round trip travel time by the average sound speed in borehole 10 between controller 22 and tool 14. The change in such round trip travel time, when correlated with the measured depth of controller 22 within borehole 10 as controller is lowered, provides sufficient information to estimate the remaining distance between controller 22 and tool 14, and the projected time of contact at various rates of controller 22 descent within borehole 10.

Although controller 22 is shown as a single component, controller 22 can comprise multiple sensors, controller units and signal transmitters which are located together or are positioned at various positions along cable 20. For example, tool 14 could be located in the sidetracked portion of borehole 10. In such a position, multiple controllers 22 could be positioned along cable 20 to detect signals emanating from tool 14. If multiple controllers 22 are located at different positions within borehole 10, triangulation calculation procedures can determine the precise location of tool 14 relative to controllers 22. Cross-correlation between signals can be used to infer direction of the signal.

Data from controller 22 can be transmitted through cable 20 or through conductors (not shown) attached to cable 20 to control equipment 32 located at the surface of borehole 10. Control equipment 32 can generate the controller signals, can receive the signals emanating from tool 14 as a reflected signal or as a beacon signal from beacon 26, and can perform all processing functions necessary to identify and locate tool 14. These functions can be performed by controller 22 downhole within wellbore 10 and a signal transmitted to an operator at the surface. Alternatively, these functions can be performed with control equipment 32 at the surface to protect sensitive electronic equipment from hazardous downhole conditions such as elevated temperatures and corrosive fluid conditions.

Figure 2:
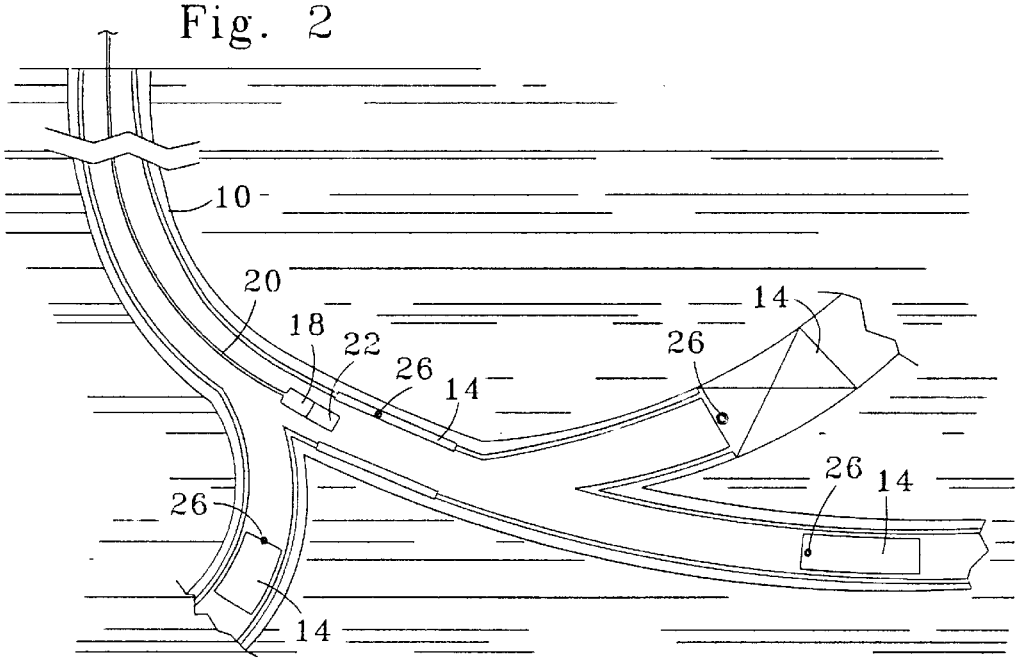
FIG. 2 illustrates multiple tools within a borehole, wherein each tool responds to a different signal broadcast from a controller.

FIG. 2 illustrates another embodiment of the invention wherein multiple tools 14 are located within borehole 10. As shown in FIG. 2, such tools can comprise well completion equipment such as sliding sleeves, valves, packers, chemical injection nozzles, or other tools. A separate beacon 26 is attached to each tool 14, and each beacon 26 is capable of generating a distinct beacon signal. When controller 22 is positioned within borehole 10, controller 22 can selectively generate different controller signals correlating with a selected beacon 26 for a selected tool 14. Selective broadcast of a controller signal will operate the beacon signal for a selected beacon 26, thereby permitting the placement of housing 18 toward the selected tool 14. This feature of the invention permits controller 22 to identify and locate one tool 14 within a multiple well tool installation. As previously noted, controller 22 can operate within an open borehole 10 or within a tubing or casing string positioned within borehole 10.

Figure 3:
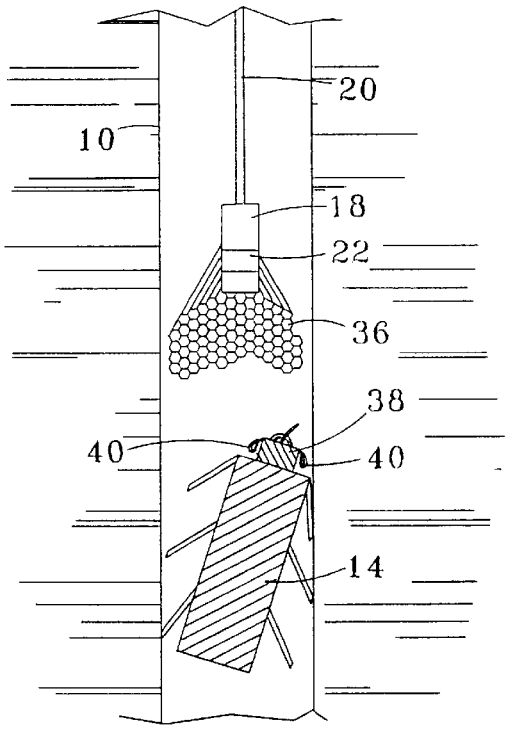
FIGS. 3 and 4 illustrate the operation of a grappling mechanism for engaging a catch on the tool and for retrieval of the tool from the borehole.
Figure 4:
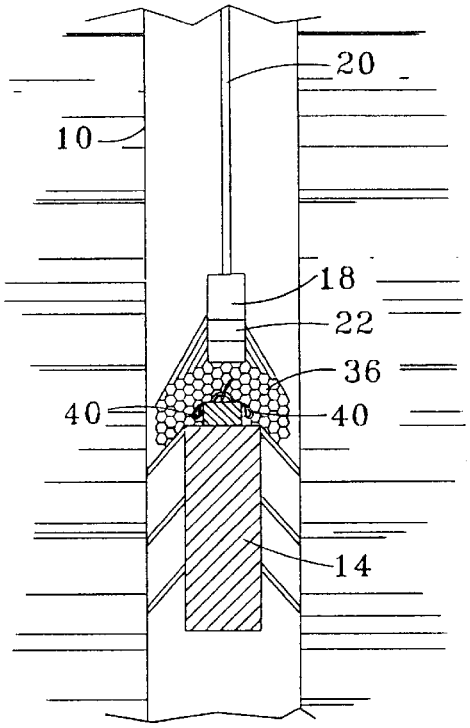

FIG. 1 illustrates one embodiment of grappling attachment 24 which is configured to encircle one end of tool 14. Operation of attachment 24 closes a metal loop around tool 14 to permit retrieval of tool 14 from borehole 10. Another embodiment of grappling attachment 34 is illustrated in FIGS. 3 and 4. In FIG. 3, housing 18 is lowered into proximity with tool 14, and controller 22 releases ring assembly 36 from an enclosure within the interior of housing 18. Ring assembly 36 comprises numerous circular rings which are released to fill the interior cross section of borehole 10. Leaf springs, floats, or other devices can expand such circular rings within the volume defined by borehole 10.

Controller signal from controller 22 activates a mechanism such as catch 38 attached to tool 14. Catch 38 can comprise many different shapes or configurations, and is illustrated as one or more retractable hooks 40 rotated outwardly from tool 14. Catch 38 is initially contained within tool 14 to prevent friction and other contact with the wall of borehole 10, and is operable to expose hooks 40 to grappling attachment such as ring assembly 34. Catch 38 can be activated with a coded signal from controller 22 which comprises a coded sequence or frequency of acoustic pulse.

By coding such open signal, premature or accidental opening of catch 38 can be prevented.

Figure 5:
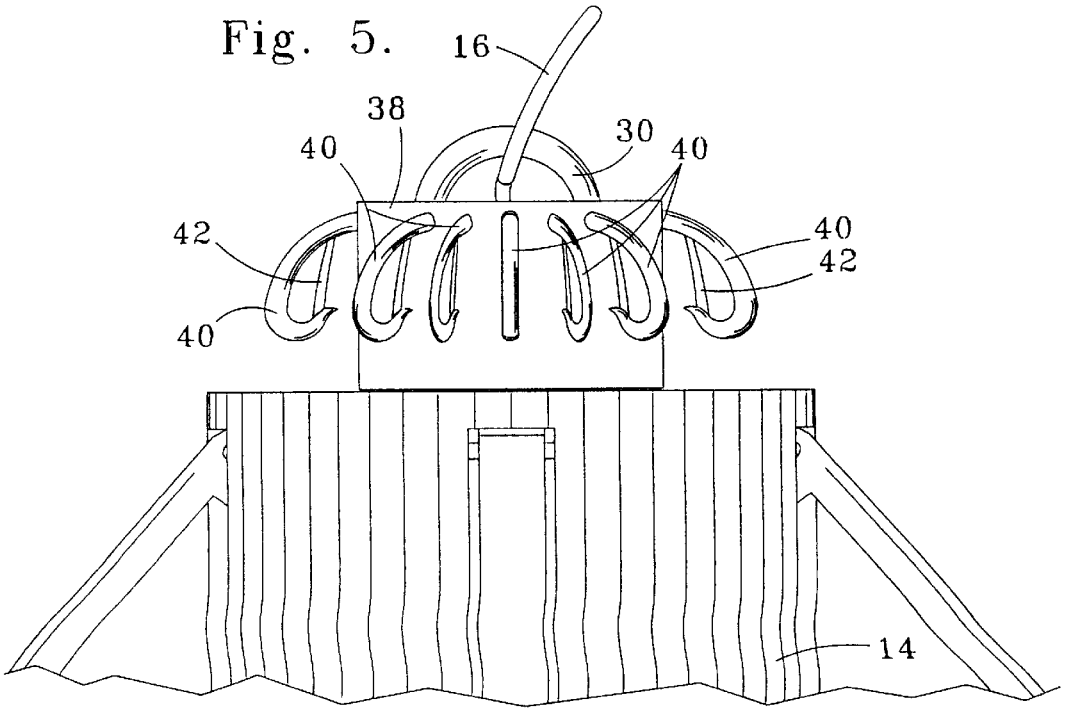
FIG. 5 illustrates a locking catch.

FIG. 4 shows catch 38 in an operable condition having extended hooks 40 in engagement with ring assembly 36. Each hook 40 can have a spring loaded gate or clasp 42 as illustrated in FIG. 5 to resist disengagement of hook 40 with ring assembly 36 after the initial engagement is made. To secure the connection between housing 18 and tool 14, cable 20 and housing 18 can be reciprocated within borehole 10 to increase the number of hooks 40 engaged with different loops within ring assembly 36. After the attachment between housing 18 and tool 14 is secured, cable 20 can be reeled in from borehole 10 surface to dislodge or to retrieve tool 14 from wellbore 10. Even if cable 20 is insufficiently strong to dislodge tool 14, cable 20 is positioned to guide the operation of conventional drill string and overshot fishing tools.

The invention is particularly useful in the location and retrieval of moveble tools such as logging tools which have become lodged or lost within a borehole. In multilateral wells having various wellbores connected to a central wellbore, the invention facilitates the entry of tool retrieval mechanisms into the correct wellbore branch. The invention accomplishes this function by providing continuous downhole communication between controller 22 and beacon 26 at tool 14. If the signals transmitted between controller 22 and beacon 26 indicate that the distance between such components is becoming greater (or the signal weaker) as housing 18 is lowered into one borehole branch within the borehole system, controller 22 or an operator at the well surface will perceive that housing 18 has entered an incorrect borehole branch and operating changes can be made.

The invention saves rig time by reducing the complexity and performance of fishing operations. By integrating a beacon 26 or signal reflector within tool 14, a positive location signal source is attached to tool 14. This source signal facilitates identification of the tool 14 location by the onsite rig operator. This onsite capability reduces the need for fishing specialists and equipment located several days travel time from the rig site. The rig operator can lower controller 22 within borehole 10 to identify tool 14, to locate the position of tool 14, and to deploy grappling equipment for engaging and for retrieving tool 14. As previously discussed, this capability is particularly useful where a moveable tool such as a logging tool has become separated from the wireline or otherwise lodged in a borehole.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for locating a tool downhole in a borehole, comprising:

a housing moveable within the wellbore;

a signal means for generating a signal indicating the tool location downhole in the borehole;

a controller attached to said housing for detecting said signal; and a mechanism for engaging the tool and said housing.

2. An apparatus as recited in claim 1, wherein said signal means comprises a beacon attached to the tool for selectively broadcasting said signal for detection by said controller.

3. An apparatus as recited in claim 2, wherein the tool is moveable within the borehole by controlling movement of the tool from the borehole surface, and wherein said beacon is activatable when such moveable control of the tool ceases.

4. An apparatus as recited in claim 1, wherein said signal means is attached to said controller for generating a controller signal, and further comprising a beacon attached to the tool and activatable by said controller signal to generate a beacon signal detectable by said controller.

5. An apparatus as recited in claim 1, wherein the tool is moveable within the borehole by controlling movement of the tool from the borehole surface, and further comprising a catch attached to the tool for engagement with said mechanism after control of the tool within the borehole is lost.

6. An apparatus as recited in claim 5, wherein said catch is initially stored in a retracted position relative to the tool, and wherein said catch is moveable from said retracted position to an operable position in response to a signal generated by said controller.

7. An apparatus as recited in claim 1, wherein said controller is capable of identifying the distance between said housing and the tool.

8. An apparatus as recited in claim 1, wherein at least two tools are located within the borehole, wherein said signal means is capable of generating a signal correlating to one of the tools, and wherein said controller is capable of detecting the signal correlating to the selected tool.

9. An apparatus as recited in claim 1, wherein the tool is stationary within the borehole, wherein said controller is capable of determining the distance between said housing and the tool until the mechanism engages the tool, and wherein said mechanism is further capable of operating the tool within the borehole.

10. An apparatus for locating and for moving a tool positioned downhole in a borehole, comprising:

a housing insertable into the borehole and moveable within the wellbore to a location proximate to the tool;

a beacon attached to the tool for generating a beacon signal indicating the downhole tool location;

a controller attached to said housing for detecting said beacon signal and for determining the distance between said housing and said beacon; and a mechanism for connecting said housing to the tool to permit movement of the tool relative to the borehole.

11. An apparatus as recited in claim 10, wherein said mechanism is capable of connecting said housing to the tool to permit retrieval of the tool from the borehole.

12. An apparatus as recited in claim 10, wherein the tool is stationary relative to the borehole, and wherein said mechanism is capable of connecting said housing to the tool to permit operation of the tool.

13. An apparatus as recited in claim 10, further comprising equipment located outside of the borehole for communicating with said controller.

14. An apparatus as recited in claim 10, wherein said controller is capable of broadcasting a controller signal, and wherein said beacon signal is operable in response to said controller signal.

15. A method for locating a tool downhole in a borehole, comprising the steps of:

moving a housing into the borehole, wherein said housing includes a controller;

operating a signal means to generate a signal indicating the tool location downhole in the borehole;

detecting said signal with said controller; and operating a mechanism to engage the tool and said housing.

16. A method as recited in claim 15, further comprising the step of moving the housing out of the borehole to retrieve the tool from the wellbore.

17. A method as recited in claim 15, wherein the tool is moveable within the borehole, said signal means is attached to the tool, and wherein said signal means generates said signal when movement of the tool ceases.

18. A method as recited in claim 15, wherein said signal means is attached to the tool, further comprising the step of operating said controller to generate a control signal for activating said signal means.

19. A method as recited in claim 18, further comprising the steps of operating said controller to determine the length of time between the control signal generation and the detection of the signal from said signal means, to determine the position of said controller within the borehole, and to calculate the distance between said controller and the tool.

20. A method as recited in claim 18, further comprising the step of activating said mechanism with said control signal to move from an initial retracted position to an operable position for engaging the tool.

* * * * *